United States Patent [19]

Mullinax

[11] Patent Number: 4,753,197

[45] Date of Patent: Jun. 28, 1988

[54] TUBE SUPPORT

[75] Inventor: Jerry L. Mullinax, Green Township, Summit County, Ohio

[73] Assignee: The Babcock & Wilcox Company, New Orleans, La.

[21] Appl. No.: 130,924

[22] Filed: Dec. 10, 1987

[51] Int. Cl.[4] ..... F22B 37/24

[52] U.S. Cl. ..... 122/510; 122/511; 165/178

[58] Field of Search ..... 122/510, 511, 235 C; 165/162, 178, 172, 67

[56] References Cited

U.S. PATENT DOCUMENTS

| | | | |
|---|---|---|---|
| 1,977,247 | 10/1934 | Scott et al. | 122/510 |
| 3,026,858 | 3/1962 | Fleischer | 122/510 |
| 3,163,155 | 12/1964 | Culver | 122/510 |
| 4,706,614 | 11/1987 | Fournier et al. | 122/510 |

FOREIGN PATENT DOCUMENTS

| | | | |
|---|---|---|---|
| 698980 | 1/1964 | Canada | 122/510 |

*Primary Examiner*—Edward G. Favors

*Attorney, Agent, or Firm*—Eric Marich; Vytas R. Matas; Robert J. Edwards

[57] ABSTRACT

A tube support for supporting horizontal tubes from an inclined vertical support tube passing between the horizontal tubes. A support button is welded to the vertical support tube. Two clamping bars or plates, the lower edges of one bearing on the support button, are removably bolted to the inclined vertical tube. The clamping bars provide upper and lower surface support for the horizontal tubes.

20 Claims, 8 Drawing Sheets

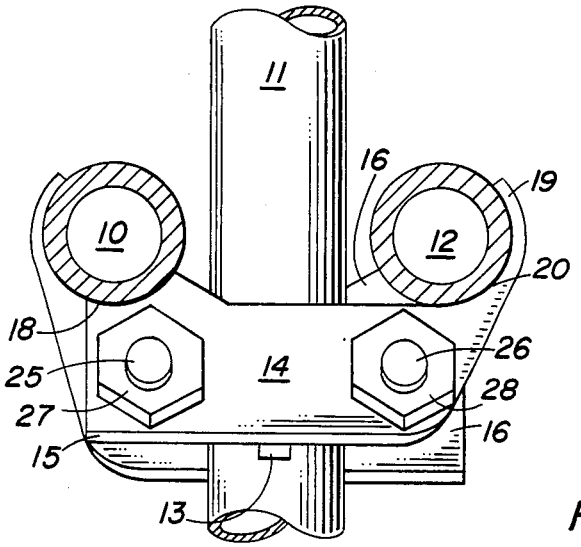
FIG. 1
FIG. 2
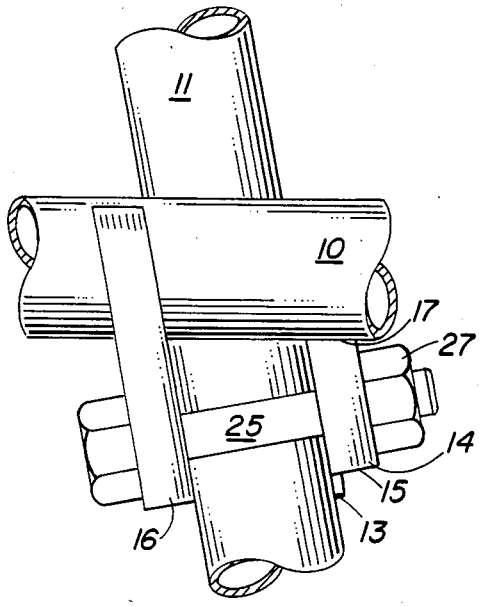

TUBE SUPPORT

BACKGROUND OF THE INVENTION

This invention relates to a tube support arrangement and, more particularly, to a clamped tube support construction for supporting horizontal tubes from vertical support tubes, at opposite sides thereof, particularly in a pressurized fluid bed boiler.

The in-bed heating surface of the evaporator or secondary superheater surfaces of certain pressurized fluid bed boiler designs includes horizontally positioned tubes. These horizontal tubes are typically supported by generally vertical support tubes that are slightly inclined from a truly vertical position.

In the past, pairs of lugs have been welded to opposite sides of the vertical support tube at longitudinally spaced intervals to form lower and upper lugs that have spaces therebetween through which the horizontal tubes extend. The horizontal tubes are closely-fitted between the lower and upper lugs and supported by the lower lug on each side of the vertical support tube. This construction permits the horizontal tubes to slide horizontally while assuring that the horizontal tubes remain in a vertically fixed position. However, if a horizontal tube needs to be repaired or replaced, the weld connection between the upper lug and the vertical support tube must be disadvantageously burned-off, thereby necessitating both replacement of the upper lug and rewelding of the new upper lug when the repairs are completed. The welding and rewelding is also detrimental to protective coatings that may be used on the tubes to increase bed surface life of the primary and evaporator tubes in the erosive environment of a fluidized bed. A need exists, therefore, for a simple, nonwelded horizontal tube support construction for pressurized fluid bed boilers that can survive an environment more severe than any in current, commercial power plant applications which at hottest points will approach surface design temperatures of 1600 to 1700 degrees Fahrenheit. This need, which is satisfied by the embodiments of the tube support construction of the invention, described hereafter, is not met, nor the inventive construction suggested by various known support arrangements for horizontal cylindrical members in nonfluidized bed applications, exemplary examples of which are now described.

U.S. Pat. No. 4,356,795, for example, discloses an arrangement in which a vertical support tube is provided with fins welded to opposite sides of the tube. The fins are cut and notched to form generally C-shaped spaces with lower lugs having an upturned lip. A bottom lug engages the lip of the lower lug. The bottom lug has an upper arcuate surface upon which a horizontal tube is seated. An upper lug is also provided which has a lower curved surface that engages the top surface of the horizontal tube. The upper lug, however, is welded to an upper lip of the fin in order to hold the horizontal tube in place. Hence, the arrangement basically embodies the principles of welded supports of the known arrangements described above but, as well, also requires a more complex construction.

U.S. Pat. No. 4,550,690 discloses a steam yoke and hanger arrangement which provides a complex support structure involving U-shaped openings for holding horizontal tubes but which is not particularly suited to support from a vertical tube.

U.S. Pat. No. 2,099,465 discloses a two-piece conductor clamp with a through bolt for securing the clamp to a wooden vertical support and for retaining the two piece clamp in position that supports one or more transversely positioned wires.

In U.S. Pat. No. 1,852,363, pairs of clamping elements are strung or threaded onto vertical tie rods in opposed or inverted relationship relative to one another so that curved arms will embrace a pair of horizontal tubes on opposite sides of the tie rods. The vertical positioning of longitudinally spaced clamps is maintained by sleeves therebetween which circumscribe the tie rods.

Other constructions include a holding device as set forth in U.S. Pat. No. 4,589,618 which discloses a holding device for a tube bundle wherein mating clamp elements grip tubes therebetween under forces developed by bolt and nut arrangements. U.S. Pat. No. 1,824,459 shows a bracket arrangement held on a vertical tube for supporting two transversely positioned tubes. U.S. Pat. No. 3,397,431 discloses a tube clamp assembly wherein through bolts secure mating U-shaped clamp portions having openings to receive tubes. In U.S. Pat. No. 2,893,698 supporting fins are secured to vertical tubes mounted for supporting horizontal tubes which are retained by means of anchoring piece. U.S. Pat. No. 2,981,974 discloses a cable suspension arrangement wherein clamping shoes are held in assembled condition by U-bolt. In U.S. Pat. No. 4,019,468, support means for furnace tubes are disclosed wherein hangers mount U-shaped straps which hold horizontal tubes.

SUMMARY OF THE INVENTION

In accordance with the invention, an improved apparatus is provided for supporting a pair of parallel horizontal tubes to an inclined vertical support tube passing therebetween in the bed of a pressurized fluidized bed boiler. The improved apparatus includes a support button fixed, preferably by welding, to the vertical support tube, a pair of clamping bars or plates, on opposed sides of the support tube extending normal relative to the horizontal tubes and vertical tube, with the bottom edge or surface of one plate bearing on the support button, a means for releasably bolting the clamping bars to the support tube in fixed relationship thereto.

The clamping bars are designed so that at least one of each has an arcuate surface which is extended below the horizontal tubes and is supportingly engaged to the bottom of the horizontal tubes and at least the other of which includes an arcuate surface engaged to an upper portion of at least one of the horizontal tubes.

The clamping bars, in accordance with a preferred embodiment of the invention, are identical in shape and construction. In one such embodiment, the clamping bars are placed at opposed sides of the vertical support tube, inverted relative to each other and each is bolted to the support tube by a U-bolt.

The clamping bars, in accordance with further embodiments of the invention, include intermediate arcuate surfaces formed in the sides of each in which the horizontal tubes are seated. A spacer bar is mounted between the clamping bars and partially encircles the horizontal tubes.

BRIEF DESCRIPTION OF THE DRAWINGS

In the accompanying drawings, forming a part of this specification, and in which reference numerals shown in the drawings designate like or corresponding parts throughout the same, FIG. 1 is a front elevation view illustrating a first embodiment of a tube support mounted to a vertical tube, shown in part, illustrating the support of a pair of horizontal tubes shown partly in section, according to the invention, FIG. 2 is a side elevation view of the tube support of FIG. 1;

DETAILED DESCRIPTION

Figure 3:
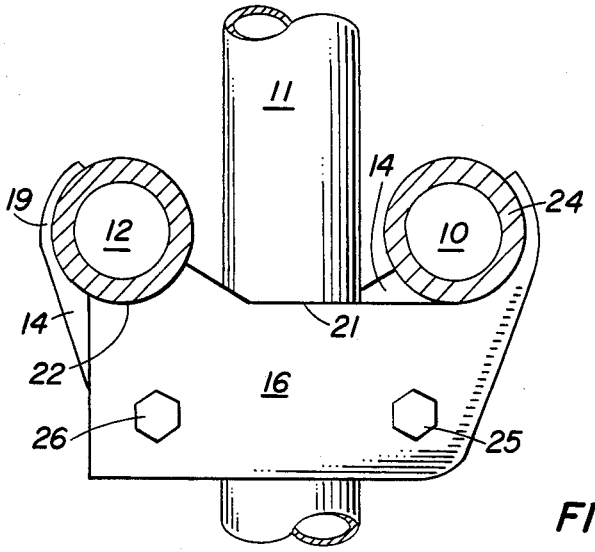
FIG. 3 is a rear elevation view of the tube support of FIG. 1.

Referring to FIG. 1, there is shown a pair of horizontally extending parallel horizontal tubes 10, 12 and a vertical support tube 11 passing between the horizontal tubes 10, 12.

The vertical support tube includes a support button 13 located at an elevation lower than the horizontal tubes 10, 12. The support button 13 is preferably a so-called weld button, i.e., small piece of metal welded to the support tube 11, which is positioned along the circumference of the support tube 11 displaced at ninety-degrees from the sides of the support tube 11 adjacent to the horizontal tubes 10, 12.

A first clamping bar 14 and a second clamping bar 16 are mounted to opposite sides of the support tube 11.

The first clamping bar 14 has a lower first surface 15, which comprises a straight edge, mounted on the support button 13 and an upper second surface 17, opposite the first surface 15. The second surface 17 has two arcuate surface portions 18, 20 for supporting the horizontal tubes 10, 12. The arcuate surface portions 18, 20 are shaped complimentary to the outer surface of the horizontal tubes 10, 12 and at least partially embrace the horizontal tubes 10, 12 within a plane including the support button 13.

In the embodiment shown in FIGS. 1 and 2, the second surface 17 comprises an upper edge of clamping bar 14 and the arcuate surface portions 18, 20 are semi-circular.

Arcuate surface portion 20 is partially formed on an elongated part 19 of clamping bar 14 that extends about and embraces the outer surface of horizontal tube 12 for more than ninety-degrees from a position tangent to the lowest portion of the tube surface to a position embracing a portion of the upper surface of the tube 12. Arcuate surface portion 19, as shown, includes a surface upon which a lower portion of the tube 10 rests.

As shown in FIG. 3, the second clamping bar 16 is provided with an upper surface 21 that includes two arcuate surface portions 22, 24 which are shaped complimentary to the outer surfaces of the horizontal tubes 10, 12. Horizontal tube 12, along a lower portion thereof, is rested upon and supported by arcuate surface portion 22. Arcuate surface portion 24 is partially formed on an elongated part 23 of clamping bar 16 and embraces the outer surface of horizontal tube 10 for more than ninety-degrees from a position tangent to the lowest portion of tube 10 to a position embracing a portion of the upper surface of tube 10.

Bolts 25 and 26 extend through bolt holes (not shown) formed in the clamping bars 14, 16 and the bars are drawn toward each other and locked against the vertical support tube 11 by torquing the nuts 27, 28 which are threadably engaged to the bolts.

Figure 4:
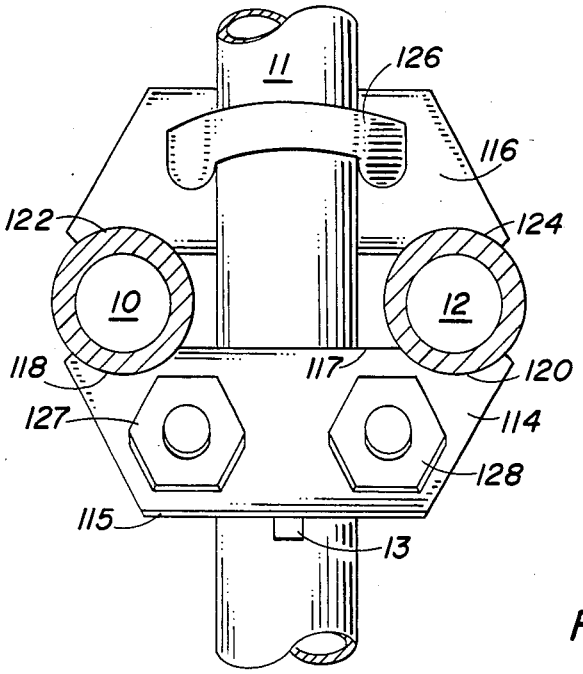
FIG. 4 is a front elevation view, similar to that of FIG. 1, illustrating a second embodiment of a tube support according to the invention.
Figure 5:
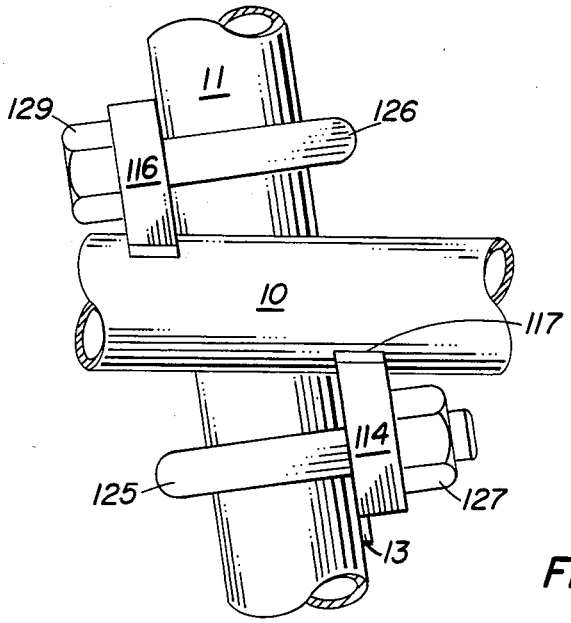
FIG. 5 is a side elevation view of the tube support of FIG. 4.
Figure 6:
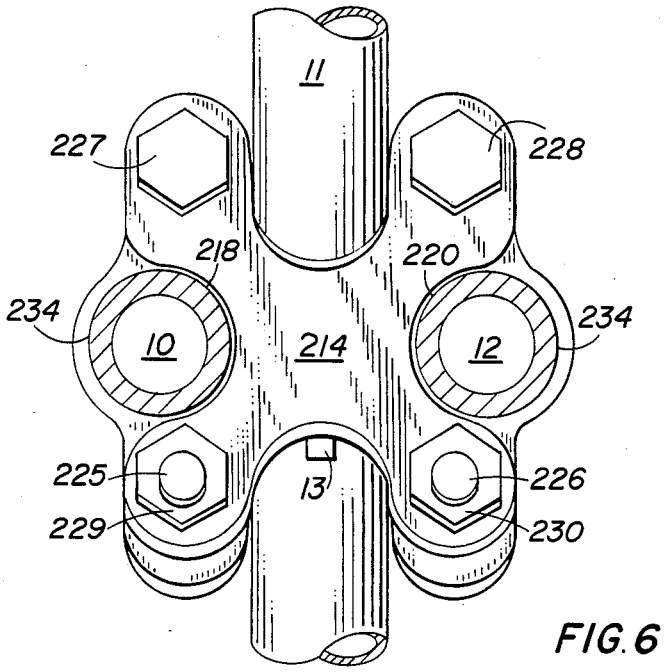
FIG. 6 is a front elevation view, similar to that of FIG. 1, illustrating a third embodiment of a tube support according to the invention.
Figure 7:
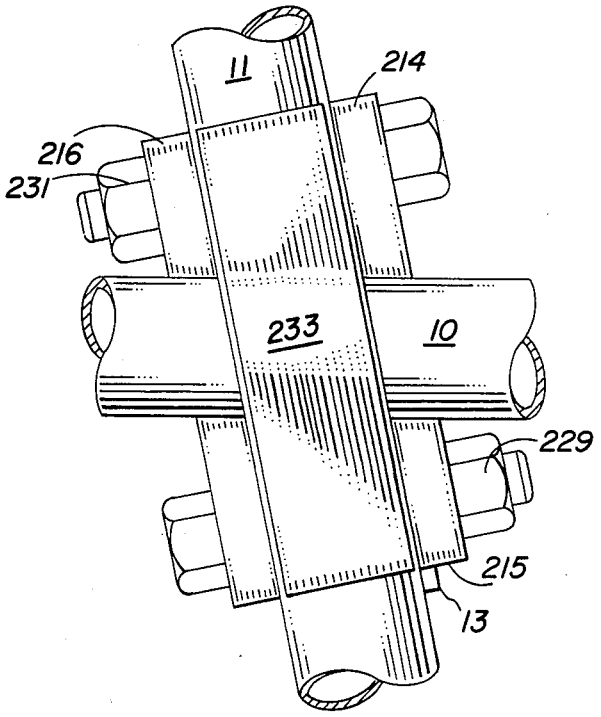
FIG. 7 is a side elevation view of the tube support of FIG. 6.
Figure 8:
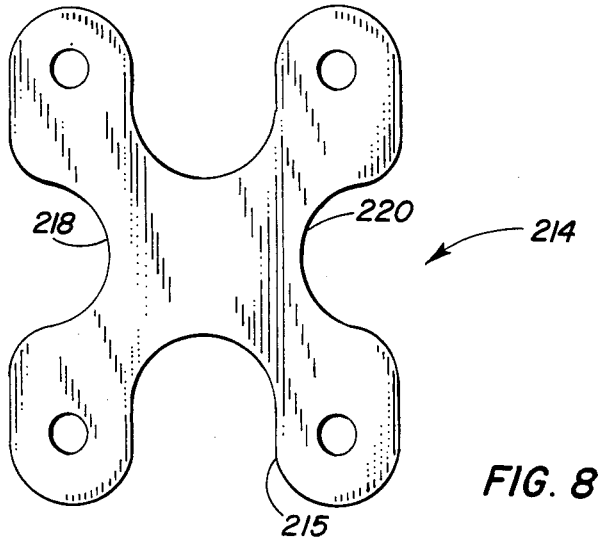
FIG. 8 is a plan view of a clamping bar of the embodiment of FIG. 6.
Figure 9:
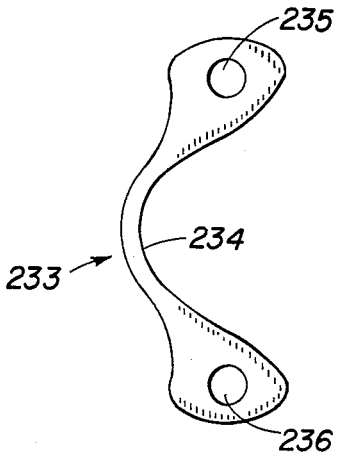
FIG. 9 is a plan view of a spacer bar of the embodiment of FIG. 6.

In accordance with a second embodiment of the invention, as shown in FIGS. 4 and 5, a first clamping bar 114 has a lower first surface 115 mounted on the support button 13 of the vertical support tube 11 and an upper second surface 117, opposite the first surface 115. The second surface 117 includes two arcuate surface portions 118, 120 for supporting the horizontal tubes 10, 12. The arcuate surface portions 118, 120 are shaped complimentary to the outer surface of the horizontal tubes 10, 12. Arcuate surface portions 118, 120, in the second embodiment, are semi-circular and identical.

A second clamping bar 116 is mounted to the side of support tube 11 opposite to clamping bar 114. The construction of clamping bar 116 is identical to that of clamping bar 114.

As shown in FIG. 4, the second clamping bar 116 is inverted relative to the first clamping bar 114. Clamping bar 116 has a lower surface that includes two arcuate surface portions 122, 124 which are shaped complimentary to the outer surfaces of the horizontal tubes 10, 12. The surface portions 122, 124, which are identical, bear against the upper surfaces of the horizontal tubes.

U-bolts 125, 126, which partly encircle the support tube 11, extend through bolt holes in each of the clamping bars 114, 116, respectively, and the bars are drawn toward vertical support tube 11 and locked to the vertical support tube by nuts 127, 128, 129, which are threadably engaged to the U-bolts.

In the third embodiment, shown in FIGS. 6–9, a first clamping bar 214 is provided which has a construction that is symmetrical about a horizontal and a vertical centerline extending therethrough. The clamping bar 214 includes a lower first surface 215 including a lower arcuate surface portion mounted on the support button 13. Two intermediate arcuate surface portions 218, 220 are provided on opposite sides of the clamping bar 214 for supporting the horizontal tubes 10, 12. The two intermediate arcuate surface portions 218, 220 are shaped complimentary to the outer surfaces of the horizontal tubes 10, 12 and partially embrace the outer surface of the tubes 10, 12 along the sides closest to the vertical support tube 11.

The second clamping bar 216 of the third embodiment has a shape and construction that is identical to the first clamping bar 214.

The first and second clamping bars 214, 216 are removably clamped in fixed relationship to the support tube 11 by four bolts 225, 226, 227, 228 which extend through bolt holes formed through the bars 214, 216 and which are secured to the bars by nuts 229, 230, 231 (only three of which are shown).

In addition, identical spacer bars 233 are provided between the clamping bars 214, 216 on opposite sides of the support tube 11. Each of the spacer bars are provided with an arcuate C-shaped recess 234 which embraces surfaces of the horizontal tubes 10, 12 at a position opposite to the intermediate arcuate surface portions 218, 220 of the clamping bars. The spacer bars 233 include bolt holes 235, 236 through which the bolts extend.

Removal of an upper bolt 227, 228 and loosening of the respective lower bolt of the third embodiment, allows the spacer bar to be rotated downwardly about the lower bolt thereby allowing ready access to a horizontal tube for repair or replacement.

As shown, the support button 13 has a length and height which is approximately one-fifth of the dimension of the diameter of the vertical support tube 11. In each of the embodiments, the support button 13 is located and centered on a vertical line on the support tube 11 which dissects the center of the first clamping bar 14, 114 or 214, the center of said clamping bar along a vertical centerline being tangent to and contacting the support tube along said line. The support button 13, moreover, is circumferentially located ninety-degrees from the sides of the support tube 11 closest to the horizontal tubes 10, 12.

The support button 13, in each of the embodiments, acts as a stop or a restraint against the tendency of the clamping bar to slide downwardly relative to the support tube.

In each of the preferred embodiments, the clamping bars are illustrated as flat plates and the lower edge of the first clamping bar 14, 114, 214 is set upon the support button 13. It will be apparent to those skilled in the art that changes can be made without departing from the invention as described in this specification or embodied by the claims. The clamping bars, for example, can be either a thin bar or a plate formed by either extrusion or casting. A bar of substantial length, relative to the support button, could be used in lieu of the button and a support button could be placed on opposite sides of the vertical support tube.

Figure 10:
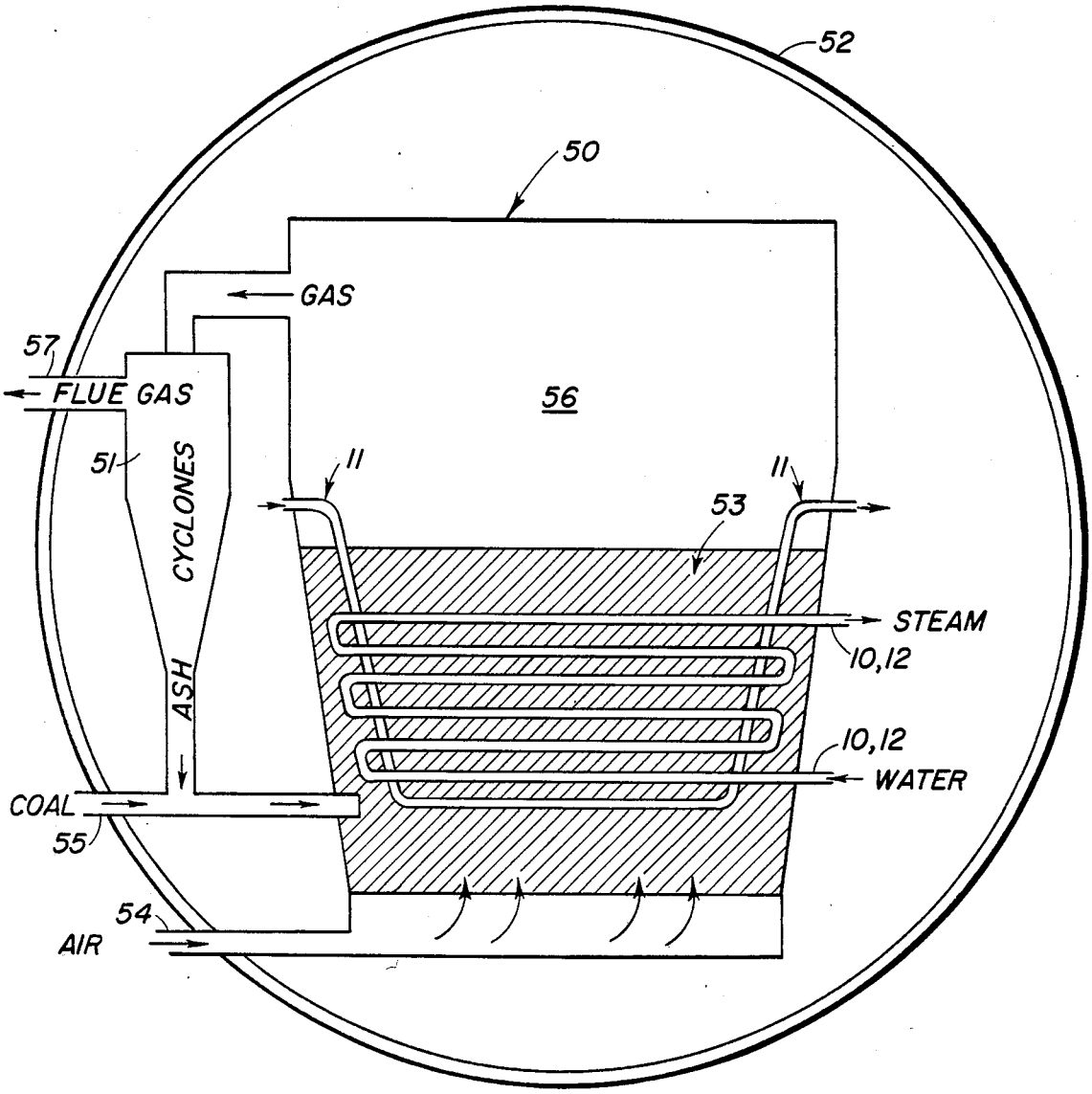
FIG. 10 is a schematic representation of a pressurized fluid bed boiler employing the tube supports of the invention.

FIG. 10 schematically illustrates a pressurized fluid bed boiler which includes a combustor 50 and cyclones 51 (only one of which is shown) which are located within a common pressure vessel 52 for elevated temperature and pressure within the pressure vessel 52.

A fluidized boiler bed 53 composed of fine-grained ash and lime or dolomite is maintained in a fluidized condition by combustion air admitted via inlet 54 from the underside of the boiler. At a certain minimum velocity of air, the particles in the bed are maintained in suspension and swirl around as though in a boiling liquid. By pressurizing the combustor to 175 to 280 psi, the necessary boiler volume is reduced and combustion improved.

Crushed coal is supplied into the bed via an inlet 55. The bed temperature is controlled by the fuel supplied and is maintained at approximately 1600° F. The boiler's steam output is then controlled by altering the bed height and temperature.

The spent gases rise to a so-called free board area 56 and exit into the cyclones 51 which separate the ash from the gas. The gases discharge through the outlet flue 57.

The in-bed heating surface is located within the fluidized boiler bed 53. The in-bed heating surface is comprised of tubes 10, 12 which are divided into a bank A of horizontal evaporator tubes; a bank B of horizontal secondary superheater tubes; a bank C of horizontal reheat tubes; and vertically inclined primary support tubes 11.

The in-bed surface tube diameters will range from 1-inch to 2-inches and the tube materials will typically be SA213T2 (CR-½) for the evaporator, SA213T22 (CFR 2¼) for the primary support tubes and SA213 TP304H (SS) for the secondary and reheat tubes. These materials are typical and will be varied to suit temperature and pressure as required.

Figure 11:
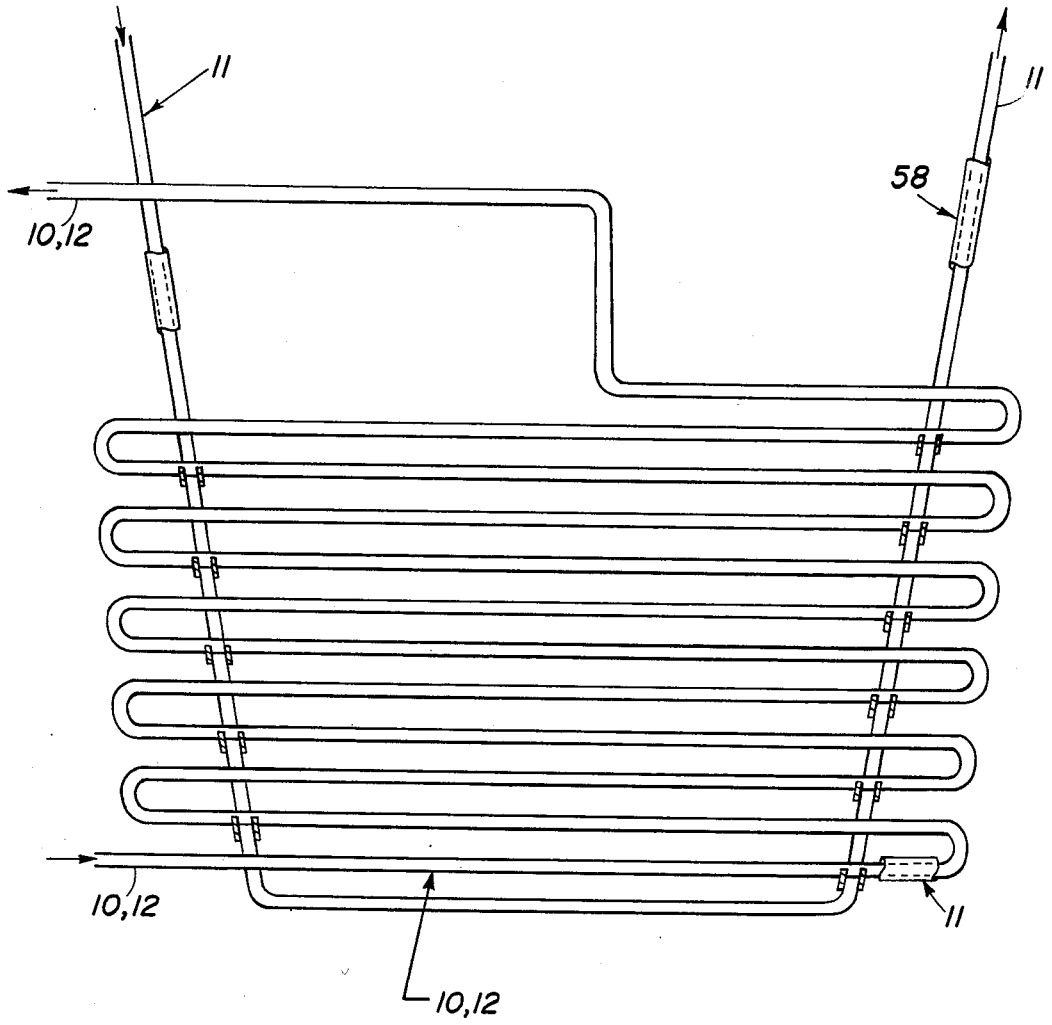
FIG. 11 is a schematic representation of an evaporator tube bank illustrating the typical locations of tube supports according to the invention.
Figure 12:
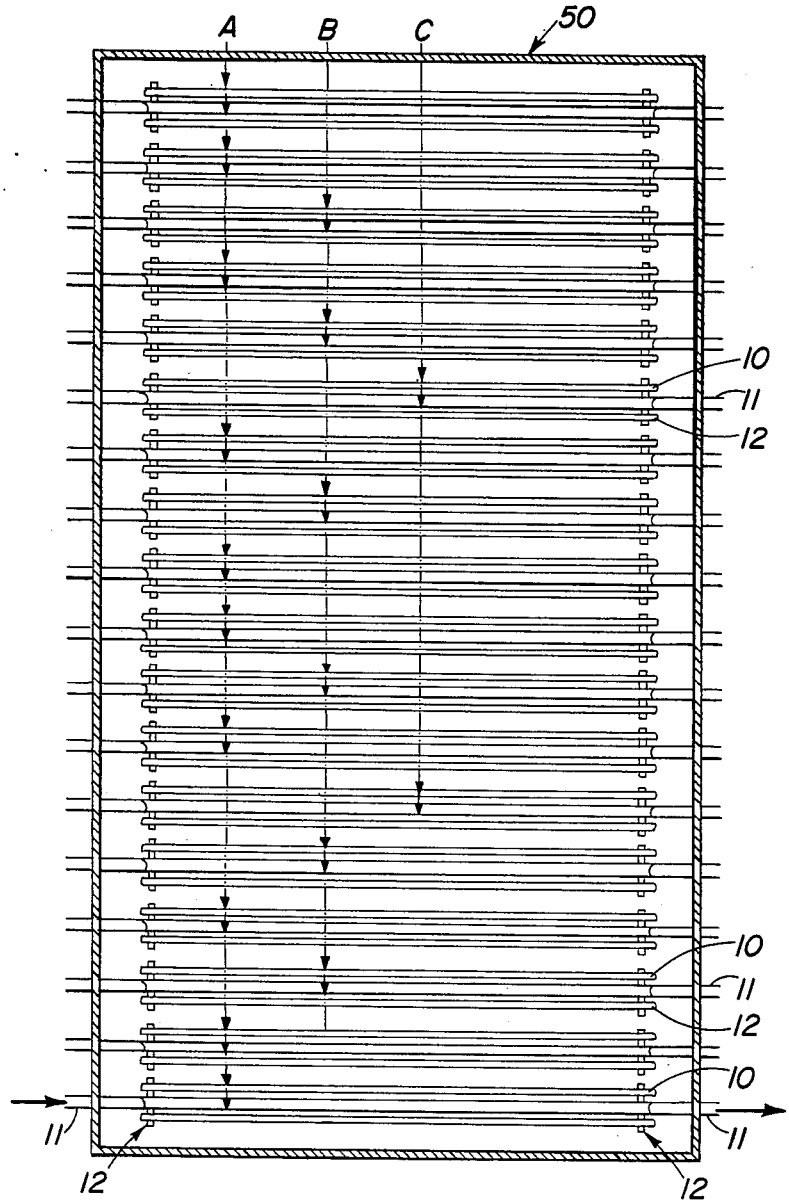
FIG. 12 is a plan view of the arrangement of FIG. 10 which illustrates relative locations of the evaporators, secondary superheater and reheat banks of tubes.

As shown in FIGS. 10, 11, and 12, water enters the evaporator tubes and primary support tubes and exits as steam. Low quality steam enters the secondary superheater tubes and reheat tubes and exists as high quality steam.

A protective coating 58, such as that produced by Kanthal Development AB of Sweden, is often required on certain lower grade tube materials, such as those which would be used for the evaporator bank tubes and the primary support tubes. These protective coatings do not permit the welding of attachments after coating. Hence, the support methods of the present invention, which do not require a welded attachment, are particularly suitable. FIG. 11 schematically shows the support locations in a typical side view arrangement of the in-bed surface of the evaporator bank.

FIG. 12 schematically illustrates a plan view of the in-bed surfaces of FIG. 10 which are attached in pairs to the primary support tubes 11.

The inventive arrangement is not limited to use in pressurized fluid bed applications but may be used in other types of boiler units that use tube coatings which do not allow welded attachments, as well as in applications utilizing noncoated tubes.

The invention claimed is:

1. An apparatus for supporting a pair of horizontally extending parallel horizontal tubes to an inclined vertical support tube passing between the horizontal tubes in a fluidized bed boiler, comprising:

a support button fixed to the vertical support tube at an elevation lower than the horizontal tubes;

a first clamping bar and a second clamping bar mounted to opposed sides of the inclined vertical support tube, the first clamping bar having a first surface mounted on the support button and a second surface extending below and supporting the horizontal tubes, and the second clamping bar having a surface engaged with a portion of at least one of the horizontal tubes; and means for bolting the first clamping bar and the second clamping bar in fixed relationship to the inclined vertical support tube.

2. An apparatus as set forth in claim 1, wherein the second surface of the first clamping bar comprises at least two arcuate surface portions, each of said arcuate surface portions partially embraced about one of the horizontal tubes.

3. An apparatus as set forth in claim 2, wherein the arcuate surface portions of the first clamping bar are semicircular.

4. An apparatus as set forth in claim 3, wherein the first clamping bar is a flat plate, and the first surface of the first clamping bar comprises a lower edge.

5. An apparatus as set forth in claim 4, wherein the lower edge is a straight edge.

6. An apparatus as set forth in claim 1, wherein said surface of the second clamping bar extends below and engages against the lower portion of the horizontal tubes.

7. An apparatus as set forth in claim 6, wherein said surface of the second clamping bar comprises at least two arcuate surface portions, each of said arcuate surface portions being partially embraced about one of the horizontal tubes.

8. An apparatus as set forth in claim 7, wherein the arcuate surface portions of the second clamping bar are semicircular.

9. An apparatus as set forth in claim 8, wherein the second clamping bar is a flat plate.

10. An apparatus as set forth in claim 1, wherein the first clamping bar and the second clamping bar are identical.

11. An apparatus as set forth in claim 10, wherein said bolt means comprises U-bolts extended partly about the inclined vertical support tube and through each of the clamping bars, and nuts threadably engaged to the U-bolts.

12. An apparatus as set forth in claim 11, wherein said surface of the second clamping bar extends above and engages against the upper portion of the horizontal tubes.

13. An apparatus as set forth in claim 12, wherein the second surface of the first clamping bar comprises at least two arcuate surface portions, ech of said arcuate surface portions partially embraced about one of the horizontal tubes.

14. An apparatus as set forth in claim 13, wherein the arcuate surface portions are semi-circular.

15. An apparatus as set forth in claim 14, wherein the first clamping bar is a flat plate, and the first surface of the first clamping bar comprises a lower edge.

16. An apparatus as set forth in claim 15, wherein the lower edge is a straight edge.

17. An apparatus for supporting a pair of horizontally extending parallel horizontal tubes to an inclined vertical support tube passing between the horizontal tubes in a fluidized bed boiler, comprising:

a support button fixed to the inclined vertical support tube at an elevation lower than the horizontal tubes;

a first and a second clamping bar mounted to opposed sides of the inclined vertical support tube, the first clamping bar having a first surface mounted on the support button and a second surface extending below and inbetween the horizontal tubes to support the horizontal tubes;

a pair of identical spacer bars, provided between the clamping bars on opposite sides of the inclined vertical support tube and extending partially around the sides of the horizontal tubes opposite the inclined vertical support tube, to support the horizontal tubes; and means for bolting the first and second clamping bars and the pair of identical spacer bars together in fixed relationship to the inclined vertical support tube.

18. An aparatus as set forth in claim 17, wherein the first and second clamping bars are symmetrical about a horizontal and a vertical centerline.

19. An apparatus as set forth in claim 18, wherein the second surface of the first clamping bar comprises at least two opposite arcuate surface portions, each of said arcuate surface portions partially embraced about one of the horizontal tubes.

20. An apparatus as set forth in claim 19, wherein the first and second clamping bars are identical flat plates, and the arcuate surface portions are semi-circular.

* * * * *